US012291804B2

(12) United States Patent
Cheng

(10) Patent No.: US 12,291,804 B2
(45) Date of Patent: May 6, 2025

(54) FABRIC WITH BUCKLE UNITS

(71) Applicant: TAIWAN PAIHO LIMITED, Chang Hwa Hsien (TW)

(72) Inventor: Allen Cheng, Chang Hwa Hsien (TW)

(73) Assignee: TAIWAN PAIHO LIMITED, Chang Hwa Hsien (TW)

( * ) Notice: Subject to any disclaimer, the term of this patent is extended or adjusted under 35 U.S.C. 154(b) by 12 days.

(21) Appl. No.: 18/233,302

(22) Filed: Aug. 12, 2023

(65) Prior Publication Data

US 2024/0117537 A1 Apr. 11, 2024

(30) Foreign Application Priority Data

Oct. 7, 2022 (TW) ..... 111138247

(51) Int. Cl.
*D04B 21/06* (2006.01)

(52) U.S. Cl.
CPC ..... *D04B 21/06* (2013.01)

(58) Field of Classification Search
None
See application file for complete search history.

(56) References Cited

U.S. PATENT DOCUMENTS 2,105,002 A * 1/1938 Miller ..... A42B 1/201 2/175.1
2,157,399 A * 5/1939 Cohn ..... A41B 11/00 2/241
5,400,441 A * 3/1995 Yoshida ..... A44B 19/34 2/244
5,540,064 A * 7/1996 Matsuda ..... D04B 21/16 66/193
6,006,552 A * 12/1999 Matsuda ..... D04B 21/16 66/193
6,298,485 B1 * 10/2001 Heller ..... A41D 27/10 2/93
9,226,540 B2 * 1/2016 Podhajny ..... D04B 1/123
10,582,734 B1 * 3/2020 Price ..... A41F 1/002
2005/0217085 A1 * 10/2005 Lu ..... A44B 19/02 24/381
2010/0319113 A1 * 12/2010 Rock ..... B32B 5/26 2/457
2016/0044980 A1 * 2/2016 Greenacre ..... A41D 1/06 2/243.1
2021/0032808 A1 2/2021 Segars et al.

FOREIGN PATENT DOCUMENTS

CN 106079616 A 11/2016
TW I612192 B 1/2018
TW M637615 U 2/2023
WO 2015188642 A1 12/2015
WO 2017174504 A1 10/2017

* cited by examiner

*Primary Examiner* — Grace Huang
(74) *Attorney, Agent, or Firm* — CKC & Partners Co., LLC

(57) ABSTRACT

A fabric with buckle units includes a fabric body and a buckle yarn. The fabric body includes a surface layer, a bottom layer and a middle layer. The surface layer is knitted by a surface knitting unit in a warp knitting manner. The middle layer is disposed and connected between the surface layer and the bottom layer. The buckle yarn is woven back and forth in the surface layer of the fabric body to form a plurality of buckle units, which protrude from at least one side of the fabric body.

13 Claims, 4 Drawing Sheets

FABRIC WITH BUCKLE UNITS

RELATED APPLICATIONS

This application claims priority to Taiwan Application Serial Number 111138247, filed Oct. 7, 2022, which is herein incorporated by reference.

BACKGROUND

Technical Field

The present disclosure relates to a fabric. More particularly, the present disclosure relates to a fabric with buckle units.

Description of Related Art

A fabric with buckle units has been seen on the market, which can be set on clothing, backpack, hat and other portable items. The said fabric can be used for pulling or lifting items and can be applied to portable items to make them more convenient in use. Further, the said fabric can be disposed on the upper of shoelaces to achieve a tightening effect.

However, one of the current methods to fix the buckle structure is to directly fix the buckle on the product by hot melt adhesion or sewing, which is a complicated manufacturing process, and the fabric of the product is unstable. While pulling the buckle, it is easy to damage the structure of the fabric, and the applicability of the fabric is reduced.

Therefore, how to increase the structural stability of the fabric with buckle units is a target of the industry.

SUMMARY

According to one aspect of the present disclosure, a fabric with buckle units includes a fabric body and a buckle yarn. The fabric body includes a surface layer, a bottom layer and a middle layer. The surface layer includes a surface knitting unit, and the surface layer is knitted by the surface knitting unit in a warp knitting manner. The middle layer is disposed and connected between the surface layer and the bottom layer. The buckle yarn is woven back and forth in the surface layer of the fabric body to form a plurality of buckle units, and the plurality of buckle units protrude from at least one side of the fabric body.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
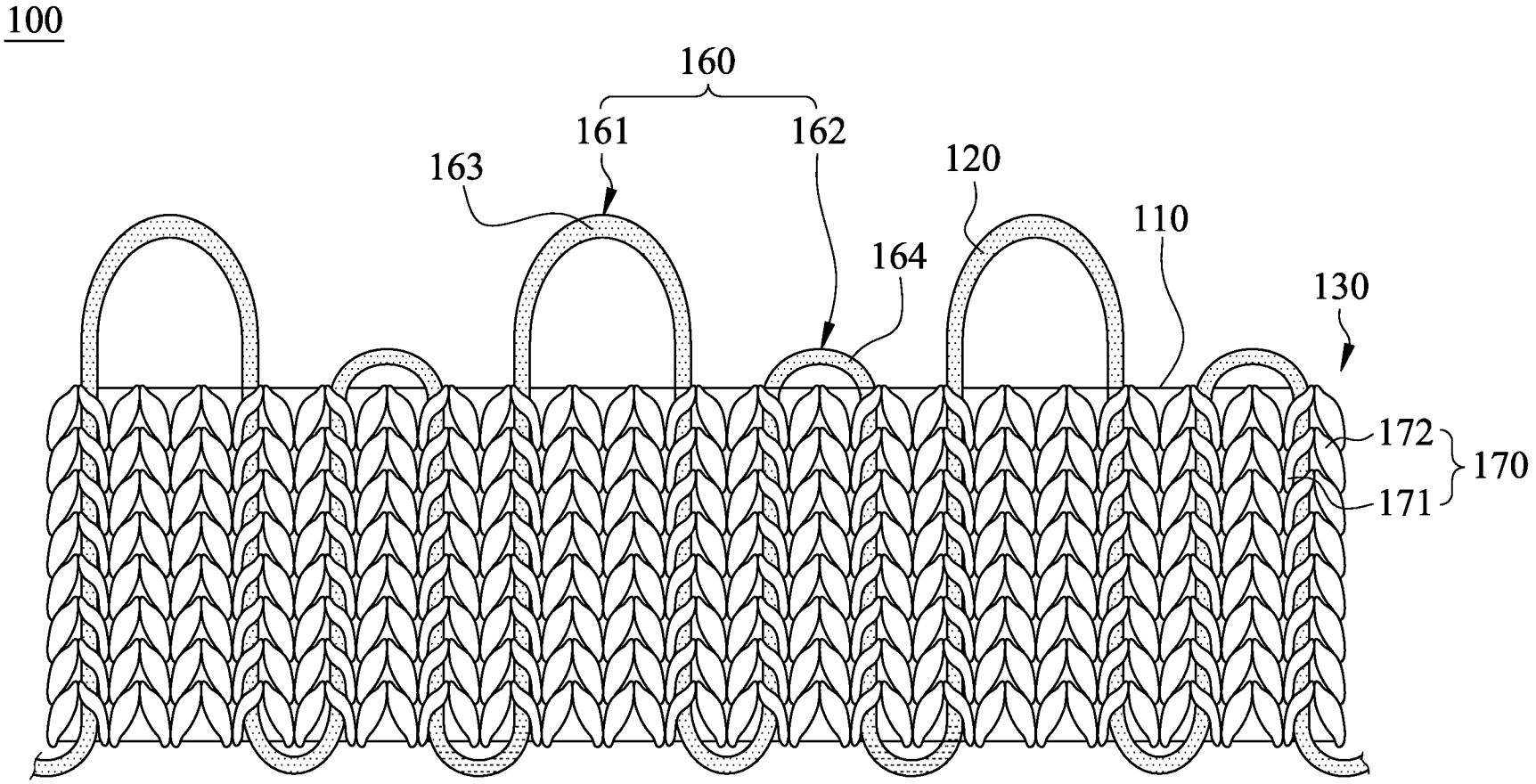
FIG. 1 is a schematic view of a fabric with buckle units according to an example of an embodiment of the present disclosure.
Figure 2:
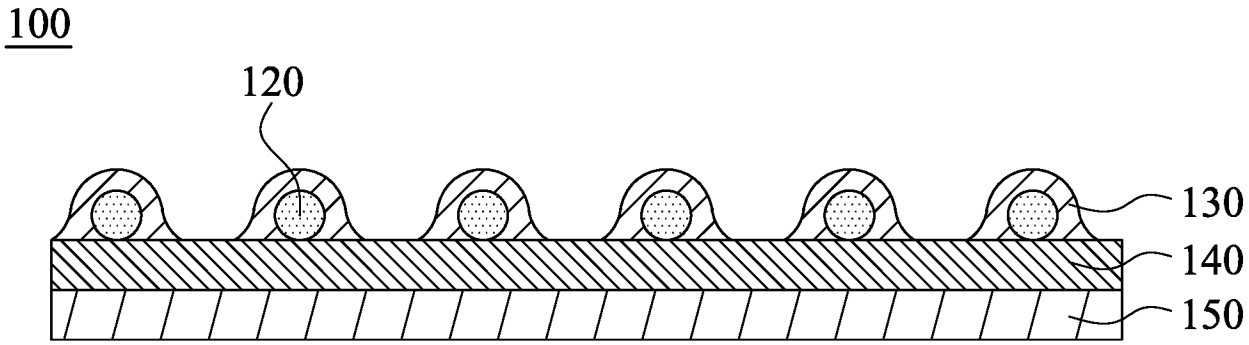
FIG. 2 is a cross-sectional view of the fabric with buckle units according to FIG. 1.
Figure 3:
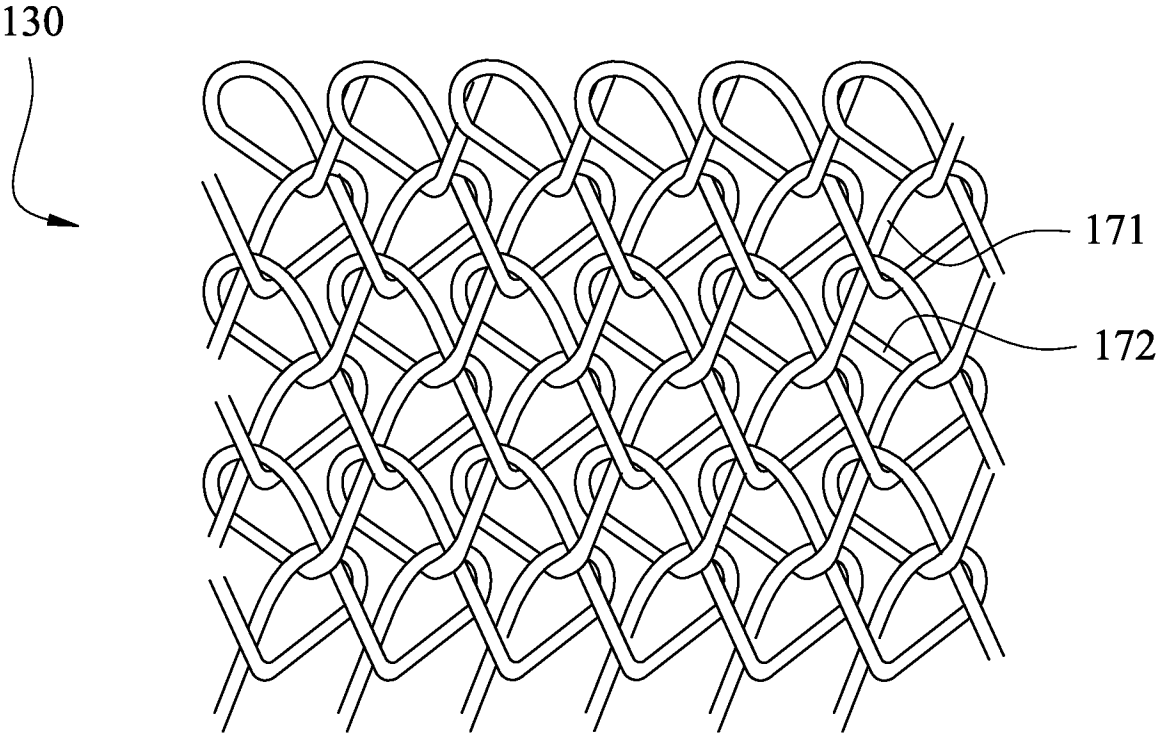
FIG. 3 is a partial enlarged view of a surface layer of the fabric with buckle units according to FIG. 1.
Figure 4:
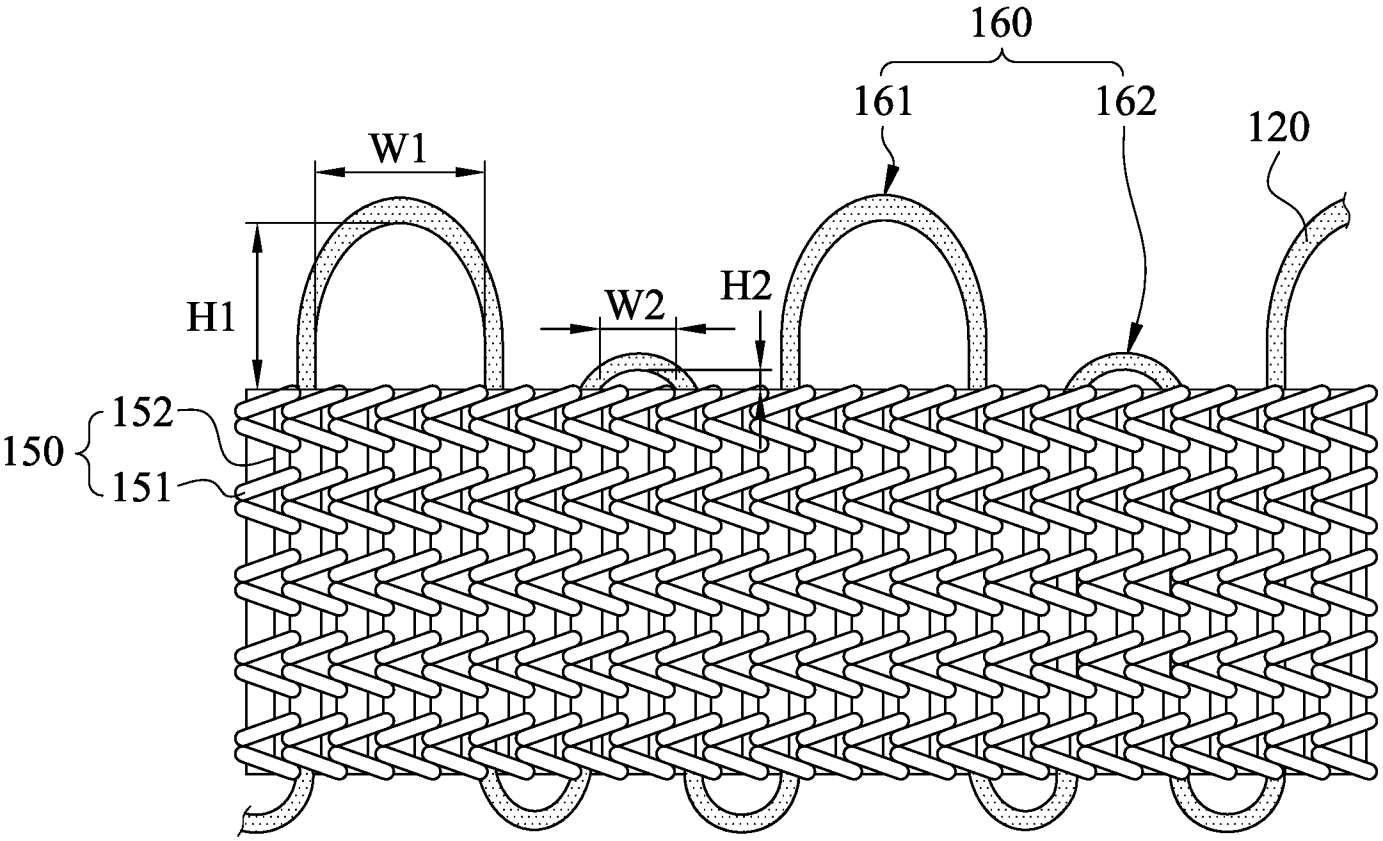
FIG. 4 is another schematic view of the fabric with buckle units according to FIG. 1.

FIG. 1 is a schematic view of a fabric 100 with buckle units 160 according to an example of an embodiment of the present disclosure. FIG. 2 is a cross-sectional view of the fabric 100 with the buckle units 160 according to FIG. 1. FIG. 3 is a partial enlarged view of a surface layer 130 of the fabric 100 with the buckle units 160 according to FIG. 1. FIG. 4 is another schematic view of the fabric 100 with the buckle units 160 according to FIG. 1.

As shown in FIG. 1, the fabric 100 with the buckle units 160 includes a fabric body 110 and a buckle yarn 120. The buckle yarn 120 is woven back and forth in the fabric body 110 to form a plurality of buckle units 160. The buckle units 160 protrude from at least one side of the fabric body 110, and the buckle units 160 can be used for lifting objects or pulling by the fingers. In the embodiment of FIG. 1, the buckle units 160 protrude from two sides of the fabric body 110.

In detail, as shown in FIG. 2, the fabric body 110 includes a surface layer 130, a middle layer 140 and a bottom layer 150. The middle layer 140 is disposed between the surface layer 130 and the bottom layer 150, and the middle layer 140 is connected to the surface layer 130 and the bottom layer 150. The buckle yarn 120 is woven back and forth in the surface layer 130 of the fabric body 110.

The surface layer 130 includes a surface knitting unit 170. The surface layer 130 is knitted by the surface knitting unit 170 in a warp knitting manner. As shown in FIG. 3, the surface knitting unit 170 can be knitted into a tricot texture.

The middle layer 140 is used to connect the surface layer 130 to the bottom layer 150. The middle layer 140 can be a warp knitted structure. Therefore, the connection strength between the surface layer 130 and the bottom layer 150 can be enhanced.

As shown in FIG. 4, the bottom layer 150 can include a warp unit 151 and a weft unit 152. The warp unit 151 is knitted with the weft unit 152 to form the bottom layer 150. In detail, the weft unit 152 can be knitted into a chain stitch texture. Therefore, the bottom layer 150 can provide a solid support through the warp and weft structural configuration, which is beneficial to increase the structural strength of the fabric 100 with the buckle units 160.

According to the above structural configuration, the overall structural stability of the fabric 100 with the buckle units 160 can be improved. The fabric body 110 is a three-layer structure, which is solid and stable. The buckle yarn 120 is only woven in the surface layer 130. Therefore, when the buckle units 160 are pulled, the buckle yarn 120 only applies force and acts on the surface layer 130 without affecting the structures of the middle layer 140 and the bottom layer 150, so that a solid support can be provided by the middle layer 140 and the bottom layer 150. Hence, the risk of breakdown of the fabric 100 with the buckle units 160 by pulling can be effectively avoided, which can further enhance the stability of the fabric 100 with the buckle units 160 while being used.

Further, as shown in FIG. 1, the buckle yarn 120 is woven back and forth in the surface layer 130 of the fabric body 110, and the buckle yarn 120 is partially pressed by the surface knitting unit 170. Therefore, the displacement of the buckle yarn 120 can be limited. Further, as shown in FIG. 2, the buckle yarn 120 can be raised on the surface of the surface layer 130, so that the surface of the surface layer 130 can show an embossing texture.

Furthermore, as shown in FIG. 3, the surface knitting unit 170 can be knitted into a tricot texture. In detail, the surface knitting unit 170 can include a plurality of first direction knitting units 171 and a plurality of second direction knitting units 172. Each of the first direction knitting units 171 is connected to each of the second direction knitting units 172 to form a V-shaped structure. As shown in FIG. 1, two side portions of each of the buckle units 160 are partially covered by the first direction knitting units 171 and the second direction knitting units 172, respectively. Therefore, the compression force in different directions can be provided by the first direction knitting units 171 and the second direction knitting units 172, and the stability of the buckle units 160 can be enhanced.

A diameter of the buckle yarn 120 can be greater than a diameter of the surface knitting unit 170, wherein the diameter refers to the thickness of the yarn. Further, a color of the buckle yarn 120 can be different from a color of the surface knitting unit 170. Therefore, the visual effect of the buckle yarn 120 and the buckle units 160 can be more obvious. In detail, the first direction knitting unit 171 and the second direction knitting unit 172 can form a twill effect in different directions on the two sides of each of the buckle units 160, and the visual impression of the product can be enhanced to improve the product recognition.

As shown in FIGS. 1 to 4, the buckle units 160 can include at least one first buckle unit 161 and at least one second buckle unit 162. The first buckle unit 161 is adjacent to the second buckle unit 162. The first buckle unit 161 has a first turning part 163, there is a first loop distance H1 between the first turning part 163 and the fabric body 110, and the first buckle unit 161 has a first loop width W1. The second buckle unit 162 has a second turning part 164, there is a second loop distance H2 between the second turning part 164 and the fabric body 110, and the second buckle unit 162 has a second loop width W2. In the embodiment of FIG. 1, the first loop distance H1 of the first buckle unit 161 is greater than the second loop distance H2 of the second buckle unit 162, and the first loop width W1 of the first buckle unit 161 is greater than the second loop width W2 of the second buckle unit 162. Therefore, the at least one first buckle unit 161 and the at least one second buckle unit 162 can be provided in different sizes, which can increase the convenience of using the fabric 100 with the buckle units 160.

In the embodiment of FIG. 1, a number of the side of the fabric body 110 is two. The at least one first buckle unit 161 can protrude from one of the sides of the fabric body 110. The at least one second buckle unit 162 can protrude from the two sides of the fabric body 110. Therefore, the first buckle units 161 and the second buckle units 162 can provide different directions of fastening function. Further, by disposing a single of the buckle yarn 120, the fastening function in different directions can be provided, and the weight of the fabric 100 with the buckle units 160 can be reduced. Therefore, the fabric 100 with the buckle units 160 has a light effect, and can be easily applied.

Further, in the embodiment of FIG. 1, a number of the at least one first buckle unit 161 is plural, and a number of the at least one second buckle unit 162 is plural. At least two of the second buckle units 162 are disposed between two of the first buckle units 161. In other words, the distance between the two first buckle units 161 can be greater than the distance between the two second buckle units 162. Therefore, different spacing can be provided.

It should be mentioned that in other embodiments, the size, the location, the direction and the number of the buckle units can be adjusted according to the requirements of need, and the present disclosure will not be limited to therein.

In summary, the fabric with buckle units of present disclosure has the following advantages. First, the fabric body is a three-layer structure, which is solid and stable. Second, the buckle yarn is woven in the surface layer, and when the buckle yarn is pulled, the buckle yarn applies force and acts on the surface layer without affecting the structure of the middle layer and the bottom layer, so that a solid support can be provided by the middle layer and the bottom layer. Therefore, the stability of the fabric with buckle units can be efficiently improved. Third, by weaving a single of the buckle yarn in the surface layer, the fastening function in different directions can be provided, and the weight of the fabric with buckle units can be reduced. Fourth, by knitting the surface layer as the tricot texture, not only the buckle yarn can be pressed stably, but also a rich visual effect on the buckle units can be displayed. Therefore, the product recognition of the fabric with buckle units of the present disclosure can be improved.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fabric with a plurality of buckle units, comprising:

a fabric body, comprising:

a surface layer comprising a surface knitting unit, wherein the surface layer is knitted by the surface knitting unit in a warp knitting manner;

a bottom layer; and a middle layer disposed and connected between the surface layer and the bottom layer; and a buckle yarn woven back and forth in the surface layer of the fabric body to form the plurality of buckle units, the plurality of buckle units protruding from at least one side of the fabric body, wherein each of the plurality of buckle units has a loop width parallel to the at least one side of the fabric body.

2. The fabric with the plurality of buckle units of claim 1, wherein the plurality of buckle units comprise:

at least one first buckle unit, wherein the at least one first buckle unit has a first turning part, and there is a first loop distance between the first turning part and the fabric body; and at least one second buckle unit, wherein the at least one second buckle unit has a second turning part, and there is a second loop distance between the second turning part and the fabric body;

wherein the first loop distance is greater than the second loop distance.

3. The fabric with the plurality of buckle units of claim 2, wherein a number of the at least one side of the fabric body is two, wherein the at least one first buckle unit protrudes from one of the sides of the fabric body, and the at least one second buckle unit protrudes from the two sides of the fabric body.

4. The fabric with the plurality of buckle units of claim 3, wherein the at least one first buckle unit is a plurality of first buckle units, wherein the at least one second buckle unit is a plurality of second buckle units, wherein at least two of the plurality of second buckle units are disposed between two of the plurality of first buckle units.

5. The fabric with the plurality of buckle units of claim 1, wherein the plurality of buckle units comprise:

at least one first buckle unit, wherein the at least one first buckle unit has a first loop width; and at least one second buckle unit, wherein the at least one second buckle unit has a second loop width;

wherein the first loop width is greater than the second loop width.

6. The fabric with the plurality of buckle units of claim 5, wherein a number of the at least one side of the fabric body is two, the at least one first buckle unit protrudes from one of the sides of the fabric body, and the at least one second buckle unit protrudes from the two sides of the fabric body.

7. The fabric with the plurality of buckle units of claim 6, wherein the at least one first buckle unit is a plurality of first buckle units, wherein the at least one second buckle unit is a plurality of second buckle units, wherein at least two of the plurality of second buckle units are disposed between two of the plurality of first buckle units.

8. The fabric with the plurality of buckle units of claim 1, wherein a diameter of the buckle yarn is greater than a yarn diameter of the surface knitting unit.

9. The fabric with the plurality of buckle units of claim 1, wherein a color of the buckle yarn is different from a color of the surface knitting unit.

10. The fabric with the plurality of buckle units of claim 1, wherein the surface knitting unit of the surface layer is knitted into a tricot texture.

11. The fabric with the plurality of buckle units of claim 10, wherein the surface knitting unit comprises a first direction knitting unit and a second direction knitting unit, and two side portions of each of the buckle units are partially covered by the first direction knitting unit and the second direction knitting unit, respectively.

12. The fabric with the plurality of buckle units of claim 1, wherein the middle layer is a warp knitted structure.

13. The fabric with the plurality of buckle units of claim 1, wherein the bottom layer comprises a warp unit and a weft unit, and the warp unit is knitted with the weft unit to form the bottom layer.

* * * * *